US006159428A

United States Patent [19]

Yamakawa et al.

[11] Patent Number: 6,159,428

[45] **Date of Patent: *Dec. 12, 2000**

[54] STRUCTURE OF GASIFIED AND MELTING FURNACE

[75] Inventors: Yuichi Yamakawa; Tsuneo Matsudaira; Sunao Nakamura; Tomohiro Yoshida; Yasuo Suzuki, all of Tokyo, Japan

[73] Assignee: NKK Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/959,787

[22] Filed: Oct. 29, 1997

[30] Foreign Application Priority Data

Oct. 31, 1996 [JP] Japan ..... 8-290008
Nov. 28, 1996 [JP] Japan ..... 8-317909

[51] Int. Cl.[7] ..... F23B 1/00

[52] U.S. Cl. ..... 422/139; 110/349

[58] Field of Search ..... 44/620, 626, 627; 252/373; 423/DIG. 6, DIG. 16; 110/235, 346, 101 A, 101 R, 116, 118, 255, 256, 347; 34/359, 368, 576, 586; 422/349; 432/32; 588/900

[56] References Cited

U.S. PATENT DOCUMENTS

| | | | |
|---|---|---|---|
| 1,832,950 | 3/1931 | Strube | 110/256 |
| 3,963,641 | 6/1976 | Pockrandt | 252/373 |
| 5,134,944 | 8/1992 | Keller et al. | 110/234 |
| 5,190,451 | 3/1993 | Goldbach | 431/5 |
| 5,236,470 | 8/1993 | Levin | 48/210 |
| 5,400,723 | 3/1995 | Okuno et al. | 110/235 |

FOREIGN PATENT DOCUMENTS

| | | | |
|---|---|---|---|
| 10883 | 9/1991 | Japan | C21B 5/00 |
| 231668 | 4/1996 | Japan | F23G 5/00 |
| 213662 | 3/1997 | Japan | F23G 5/00 |
| 9-145256 | 6/1997 | Japan . | |

OTHER PUBLICATIONS

Perry, Robert et al., Perry's Chemical Engineers' Handbook, Coal Conversion, p. 27–13–27–18, 1997.

Jolley, L.J. et al., "Fluidized Gasification of Noncaking Coals with Steam in a Small Pilot Plant", Gasification and Liquefaction of Coal, p. 60–72, 1953.

*Primary Examiner*—Marian C. Knode
*Assistant Examiner*—Frederick Varcoe
*Attorney, Agent, or Firm*—Nixon & Vanderhye

[57] ABSTRACT

A structure of a gasified and melting furnace comprising a freeboard portion whose center axis is shifted from a center axis of a lower furnace portion by 50% or more of an inner furnace diameter, to load waste and additives and to measure a height of a deposition layer formed in the lower furnace portion, without passing through the freeboard.

1 Claim, 3 Drawing Sheets

STRUCTURE OF GASIFIED AND MELTING FURNACE

BACKGROUND OF THE INVENTION

The present invention relates to a structure of a gasified and melting furnace and an operation method thereof.

First, a furnace structure will be explained.

Conventional gasified/melting furnaces and ash melting furnaces have a freeboard for suppressing generation of tar and dioxin in a generated gas and for preventing dust scattering. Such a freeboard has been provided above a deposition layer formed in a furnace, as shown in FIG. 3.

However, the freeboard has some drawbacks since it occupies a broad space in the upper portion of the furnace.

First drawback is that the loading material such as waste must be loaded to the furnace from a feed opening provided in either diagonal upper portion or the top portion of the freeboard. When a material for adjusting components in the melt (hereinafter referred to as "component adjuster"), ash, and waste are loaded from the feed opening provided in the diagonal upper portion, they distribute in the furnace in different ways depending upon the difference in specific gravity. In other words, they distributes non-uniformly. Because of the non-uniform distribution, they are not mixed sufficiently, failing in adjustment of components. The resultant melt therefore increases in viscosity, so that stable discharge of the melt is not attained.

When waste is loaded from the feed opening provided in the top of the freeboard, as disclosed in Jpn. Pat. Appln. Publication No. 1-184314, small-sized materials of the loading waste tend to be scattered like a dust. As a result, the amount of disposal ash increases, raising a waste treatment cost, dramatically.

When an auxiliary fuel such as coke is loaded to a furnace as disclosed in Jpn. Pat. Appln. Publication No. 4-122486, it is loaded from a considerably higher position. There is a high possibility for the auxiliary fuel to be broken into pieces since it receives strong impact when it reaches the surface of the deposition layer. The spaces of the deposition layers for gas flow are filled with the resultant pieces. As a result, the auxiliary fuel will lose its original function.

There is another drawback. It is very difficult to measure the layer height of the deposition layer (here-inafter referred to as "layer height"), since the distance from the top of the freeboard to the surface of the deposition layer is very long.

To explain more specifically, since the freeboard portion has a high temperature and occupies a broad area right above the surface of the deposition layer, it is very difficult to measure the layer height through the freeboard. When the layer height is determined by a measuring device equipped with a weighted wire (often used in a powder-containing tank), a wire is easily broken with heat. When the layer height is determined by a measuring device with an electromagnetic wave or the like, the accuracy and steadiness of the measurement results are significantly low due to the long distance from the measuring device to the surface of the deposition layer. In addition, the measuring device mistakenly measures clinker grown in the furnace for the deposition layer. Likewise, the layer height cannot be measured stably without fail.

BRIEF SUMMARY OF THE INVENTION

The furnace structure of the present invention has been attained in consideration of the aforementioned problems. An object of the present invention is to provide a structure of a gasified and melting furnace in which loading of waste and additives and measurement of a height of the waste deposition layer formed in a lower furnace portion can be performed without passing though the freeboard portion.

To attain the aforementioned object, a structure of the gasified and melting furnace of the present invention comprises a freeboard portion whose center axis is shifted from the center axis of the furnace by 50% or more of an inner furnace diameter, to load the waste/additives and to measure a height of a waste deposition layer formed in the lower furnace portion without passing through the freeboard portion.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The furnace structure of the present invention has been attained on the basis of the following findings. Up to date, priority is given to the quality improvement of a generated gas over stable operation. To improve the gas quality, a freeboard has been preferentially provided above the deposition layer. However, the improvement of the gas quality can be made in a gas treatment system provided downstream. In addition, it has been confirmed from experiments that even if the freeboard portion is shifted from the center of the furnace, the shift has no effect on the gas quality. Hence, priority must given to the stable operation over the quality improvement of the gas.

Figure 1:
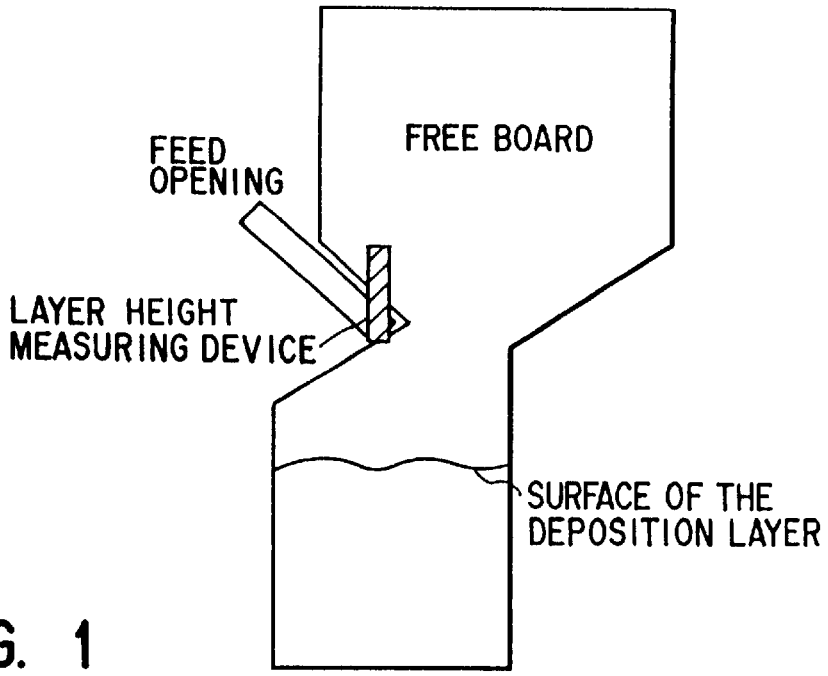
FIG. 1 is a view of an embodiment of a furnace structure of the present invention.

The axis of the freeboard is shifted from the center axis of the lower furnace portion by 50% or more of an inner furnace diameter, as shown in FIG. 1, in consideration of loading manner and layer-height measurement. Even if the center axis of the freeboard portion is shifted in excess of 50%, there is no significant difference in effect produced by the shift.

If the freeboard portion is shifted from the center axis, waste etc. can be loaded from the center axis portion and distributed in the furnace uniformly. As a result, the melt can be efficiently mixed with the component adjuster. Since the melting point of the melt can be appropriately controlled, it is possible to discharge the melt constantly.

In the present invention, since the layer height can be directly measured without passing through the freeboard portion, a measuring device equipped with a weighted wire can be used in contact with the deposition layer relative low in temperature. Since the distance between the measuring device and the surface of the deposition layer is short and obstacles such as clinker are hardly grown between them, the measuring device remotely controlled by an electromagnetic wave or the like may be used. Thus, stable measuring operation can be attained.

As described above, stable operation can be ensured.

Figure 3:
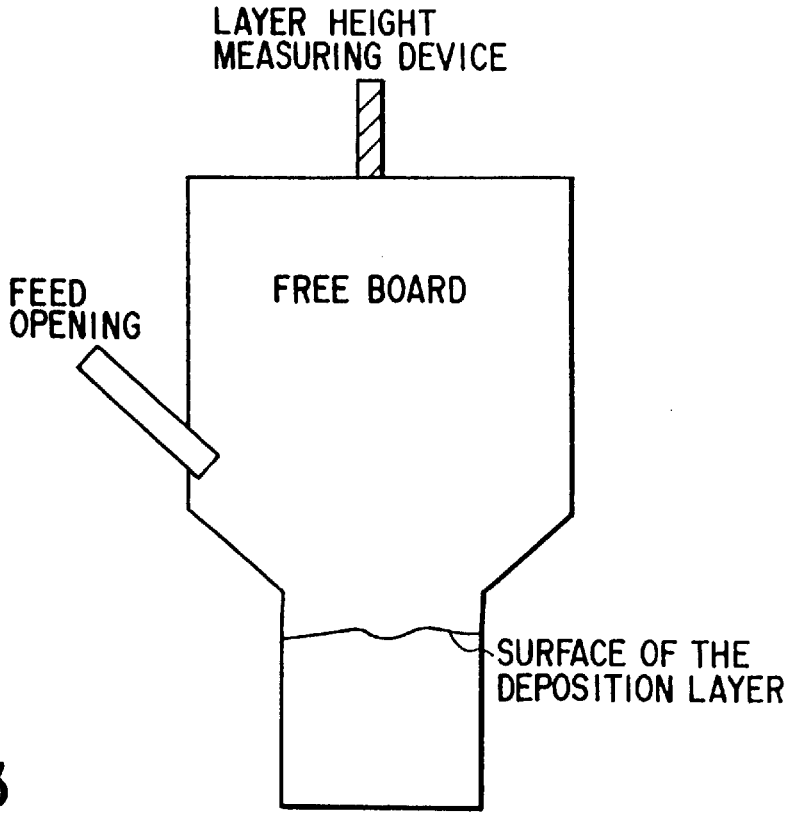
FIG. 3 (PRIOR ART)
FIG. 3 is a view of a structure of conventional furnace.

Now, the structure and function of the furnace according to the present invention shown in FIG. 1 will be described in detail in comparison with those of a conventional furnace structure shown in FIG. 3.

In the conventional furnace, since the freeboard is provided right above the deposition layer, waste etc. must be loaded into the furnace from a feeding opening provided at the diagonal upper portion. Therefore, some materials drop to a position close to the feeding opening and other materials drop to a position far away therefrom. They are thus distributed non-uniformly, with the result that the component adjuster cannot be mixed well with the residue and ash component to be melt. Since components constituting the melt are non-uniformly mixed, the melt varies in melting point and viscosity. It is therefore difficult to discharge the melt constantly.

Figure 2A:
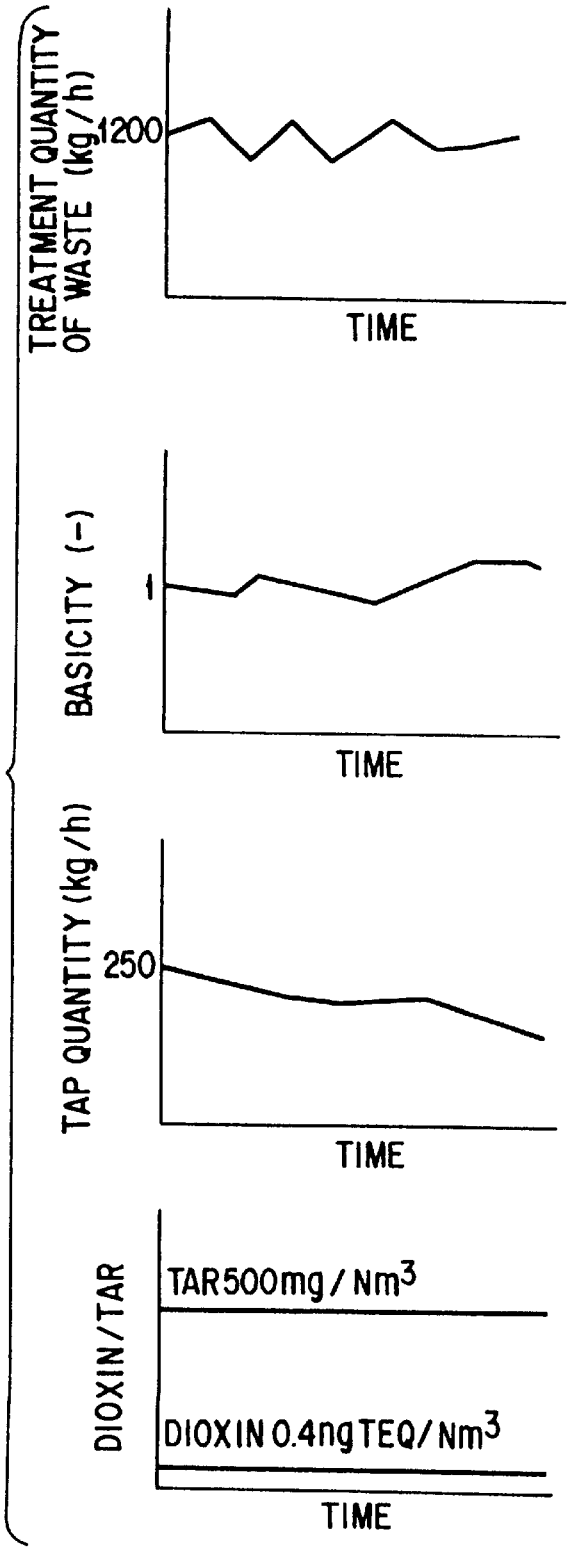
FIG. 2A (PRIOR ART)
FIG. 2A shows data obtained by operating the conventional furnace.
Figure 2B:
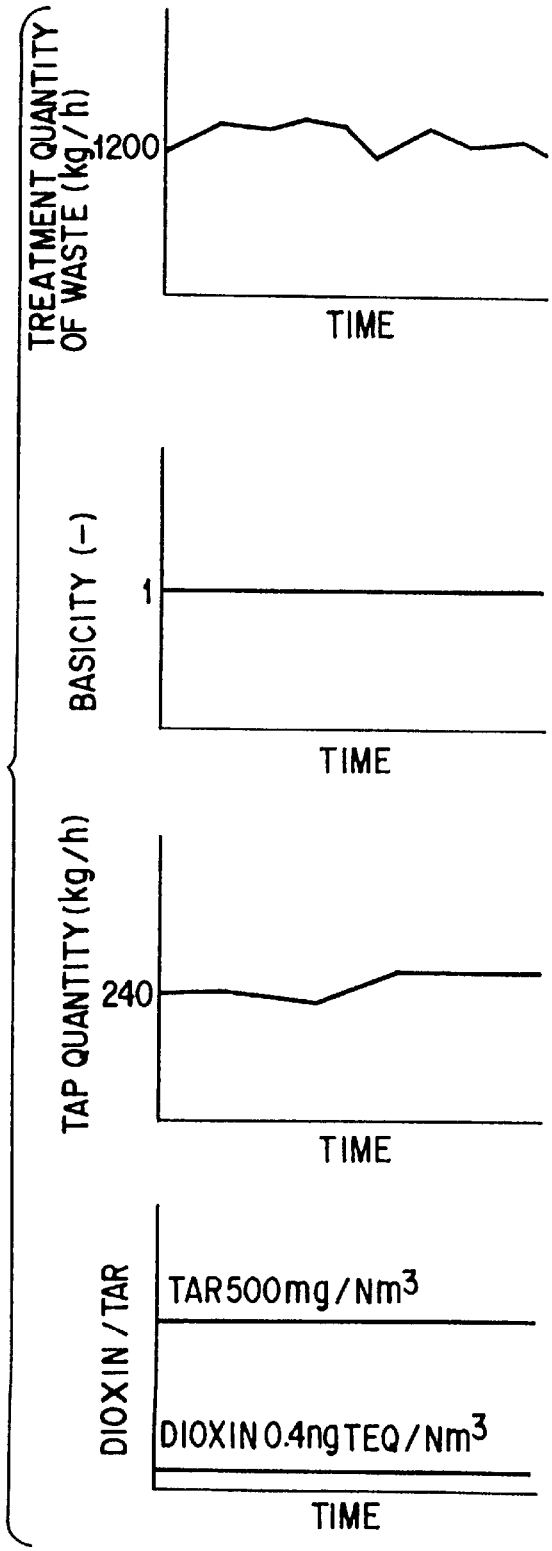
FIG. 2B shows data obtained by operating the furnace of the present invention.

FIG. 2 shows test results obtained by operating the conventional furnace (A) and the furnace of the present invention (B).

In the conventional furnace, despite that the waste and the auxiliary fuel are loaded in constant amounts in every time, the melt is not discharged in a stable amount (tap quantity). This is because the melt is not formed of steady components. If the components changes, the basicity of the melt changes, thereby changing the melting point and viscosity of the melt. Hence, the melt is not discharged constantly. The basicity used herein generally serves as an index of components of the melt and expressed in terms of $CaO/SiO_2$% by weight.

On the other hand, when the furnace of the present invention comprising the freeboard which is shifted laterally by 50% and a feeding opening which is provided right above the surface of the deposition layer, was actually operated, the waste and additives were loaded and distributed uniformly relative to the center axis of the furnace, thereby improving the state of the residue/ash/adjuster mixture. As a result, the melt was prepared with theoretical compositions and discharged constantly.

Dioxin and tar were seldom contained in a generated gas. From the test data, it was confirmed that the freeboard of this invention have the same effects as obtained in the conventional case.

Since the surface temperature of the deposition layer was 700° C., the layer-height was able to be measured by a measuring device equipped with a weighted wire without breakage or elongation of the wire. When the layer-height was measured by the measuring device with an electromagnetic wave such as a microwave, steady measurement was attained since the distance between the measuring device and the deposition layer is short and obstacles are hardly grown between them.

Consequently, stable operation of the furnace can be achieved by the achievement of constant melt discharge and accurate layer-height control.

As described above, the present invention is advantageous in that the melt is constantly mixed with the component adjuster and that the layer-height can be measured without a measurement error.

Now, we will discuss a method of operating the gasified and melting furnace of the present invention.

BACKGROUND OF THE INVENTION

Figure 5:
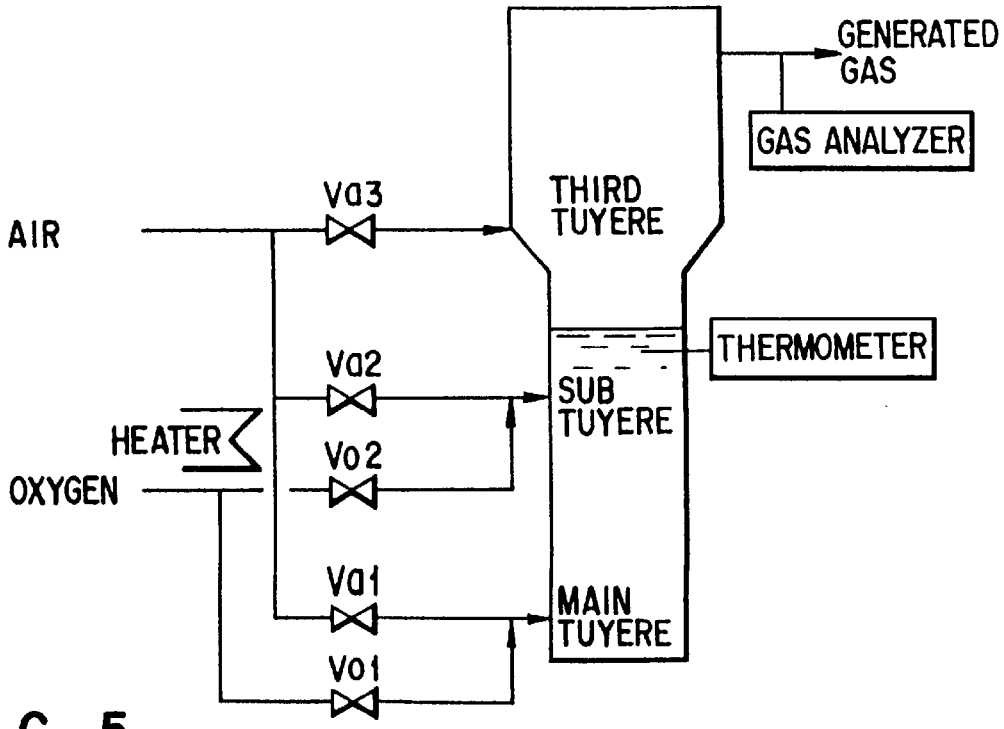
FIG. 5 (PRIOR ART)
FIG. 5 shown a structure of a furnace which is operated I accordance with the conventional method.

A conventional operation method will be explained with reference to a conventionally used furnace (shown in FIG. 5) which is a shaft type gasified and melting-furnace comprising the depositing layer consisting of an upper fluidized bed and a lower moving bed.

In the furnace, air is virtually supplied from a main tuyere to a lower furnace portion. At this time, if necessary, oxygen may be added to the air. In this way, a high temperature region (1600° C. or more) is formed in the moving bed of a depositing layer, thereby melting incombustible components of the waste.

Furthermore, air (containing oxygen if necessary) is supplied to the fluidized bed by way of a sub tuyere to make a fluidized portion in the upper depositing layer. Since the waste material is dry-distilled in this manner, the waste can be moved down to the lower portion smoothly.

The temperature of the freeboard is maintained at a value as high as 1000° C. or more by supplying air from the third tuyere to prevent dioxin generation and decompose a tar component. The generated gas is, therefore, suitably used in a gas turbine.

BRIEF SUMMARY OF THE INVENTION

When waste different in properties (calorific value, moisture content) or in amount is loaded to a conventional furnace, the inner temperature of the furnace sometime increases since the blast supplied from the sub tuyere contains only air and oxygen. In this case, if the blast amount is reduced, gas velocity decreases to equal to or less than a fluidized velocity, with the result that upper depositing layer cannot be fluidized. Hence, we cannot employ a method of reducing the temperature of the fluidized bed by decreasing the amount of the blast.

The high temperature portion is therefore formed at the distal end of the sub tuyere, and then, the incombustible components of the waste in the vicinity of the distal end are partially melt to grow clinker on the furnace wall. The clinker helps to form a bridge of waste which prevents the waste from moving downward.

The present invention is directed to provide a method of operating a gasified and melting furnace which can overcome the aforementioned problems.

The present invention provides a method of operating a gasified and melting furnace which is a shaft type furnace having a deposition layer consisting of an upper fluidized bed and a lower moving bed, comprising a step of adding vapor, exhaust gas, and oxygen to a blast air for a sub tuyere, either in a single form or in a combination form, while the amount of a blast air for a main tuyere is controlled, in order to control temperature of a fluidized portion of the deposition layer and to maintain fluidized conditions of the upper deposition layer.

In the operation method, the temperature of the fluidized bed is preferably set at 500 to 1000° C.

On the other hand, if we employ a method of reducing the blast amount to decrease the temperature of the fluidized portion, the deposition layer and particles in a raceway in the vicinity of a sub tuyere are not sufficiently fluidized because of the shortage of the air. In addition, a high temperature portion is formed in the vicinity of the sub tuyere, melting the incombustible components of the waste. The melted components attached and grow on the wall around the sub tuyere.

Then, to overcome the aforementioned problems, vapor, exhaust gas, and oxygen are supplied to a sub tuyere in a single form or a combination form.

In this manner, the oxygen concentration of the blast can be controlled while the blast amount required for maintaining the fluidized state is being ensured. In other words, the temperature of the fluidized portion can be controlled while the deposition layer is appropriately allowed to fluidize.

Controlling of the oxygen concentration means that the oxygen amount of the blast is controlled. It further means that the calorific value generated in the depositing layer can be controlled. When vapor is further supplied to the blast, a shift reaction ($CO+H_2O \rightarrow CO_2+H_2$) occurs. As a result, a $CO/H_2$ value of the generated gas decreases. The resultant gas is thus suitable as a fuel for use in a gas turbine.

DETAILED DESCRIPTION OF THE INVENTION

Figure 4:
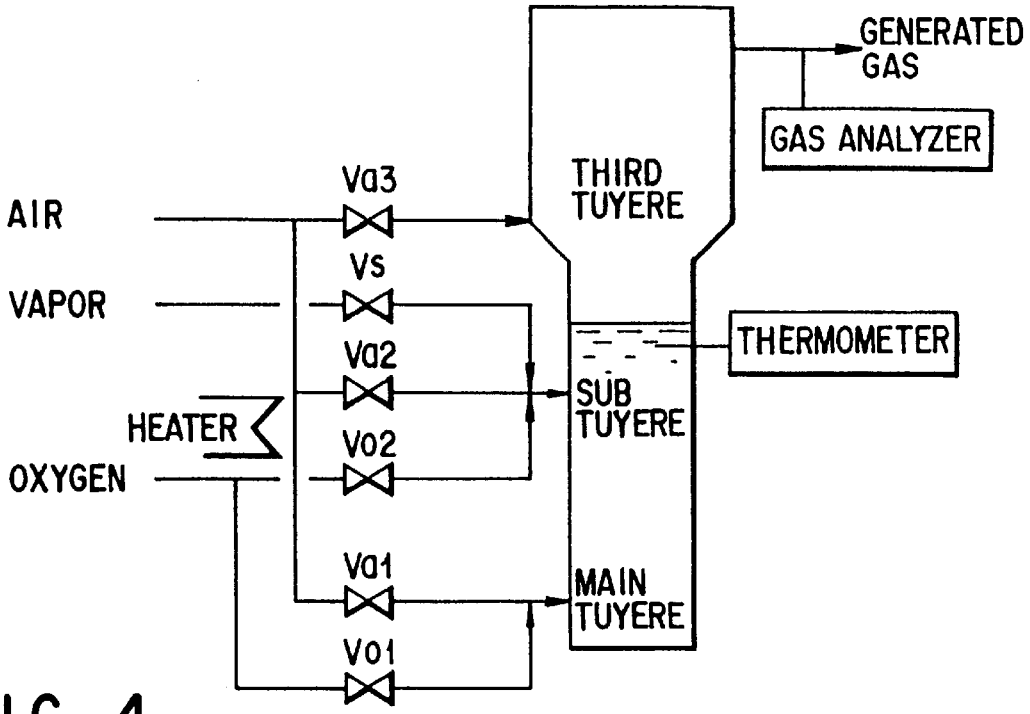
FIG. 4 shows a structure of a furnace which is operated in accordance with the method of the present invention.

The structure of a furnace which is operated according to the method of the present invention, will be explained with reference to FIG. 4.

Air is supplied through Va1 and oxygen through Vo1 to a main tuyere which is provided at the lower furnace portion. In this case, if the temperature of the blast to be supplied to the main tuyere is increased by a heater, the amount of oxygen to be added to the blast can be reduced.

Air is supplied through Va2, vapor through Vs, and oxygen through Vo2 to a sub tuyere which is provided at the fluidized bed. A thermometer is provided to measure temperature of the fluidized portion.

Air is supplied through Va3 to the third tuyere which is provided at the freeboard portion. To analyze gas components generated from the freeboard portion, an gas analyzer is provided.

The air amount to be supplied to the main tuyere is controlled by Va1 and the oxygen amount is controlled by Vo1.

By controlling the blast amount to be supplied to the sub tuyere, a predetermined gas velocity can be obtained, at the same time, the upper layer of the depositing layer can be fluidized.

In the cases where the gas supply (gas velocity) is a lower limit or less, within the standard value, and an upper limit or more, appropriate operation procedures are shown in Table 1 further with respect to the cases in which the temperature of the fluidized bed is 500° C. or less, from 500° C. to 1000° C., and 1000° C. or more.

TABLE 1

| Gas amount | Lower limit or less | Within standard value | Upper limit or more |
|---|---|---|---|
| Temperature of fluidized bed | | | |
| 500° C. or less | Air: increased<br>Vapor: constant<br>Oxygen: constant | Air:<br>Vapor: *<br>Oxygen: | Air: decreased (constant ratio)<br>Vapor: decreased (constant ratio)<br>Oxygen: decreased (constant ratio) |
| 500° C.–1000° C. | Air: increased<br>Vapor: constant<br>Oxygen: constant | Air: constant<br>Vapor: constant<br>Oxygen: constant | Air: decreased (constant ratio)<br>Vapor: decreased (constant ratio)<br>Oxygen: decreased (constant ratio) |
| 1000° C. or more | Air: constant<br>Vapor: (increased)<br>Oxygen: degreased | Air: (degreased)<br>Vapor: <increased><br>Oxygen: decreased | Air: decreased (constant ratio)<br>Vapor: decreased (constant ratio)<br>Oxygen: decreased (constant ratio) |

Operation starts under the conditions outside of parentheses ( ). When oxygen volume reaches zero, the conditions within parentheses ( ) are employed. When air volume reaches zero, condition within < > are employed.

*① Vapor amount is decreased within the maximum theoretical flame temperature of 2750° C. or less.

② Increased while maintaining a constant ratio of air/oxygen/vapor volume.

TABLE 2

| Run | | 1-1 | 1-2 | 1-3 | 1-4 | 1-5 |
|---|---|---|---|---|---|---|
| Air amount supplied from sub-tuyere | Nm3/h | 1245 | 1300 | 1300 | 1265 | 820 |
| Oxygen amount supplied from sub-tuyere | Nm3/h | 0 | 0 | 0 | 0 | 105 |
| Vapor amount | kg/h | 0 | 0 | 117 | 35 | 400 |
| Fluidized bed temperature | ° C. | 1000 | 1045 | 1000 | 1000 | 1000 |
| Generated gas $CO/H_2$ | — | 0.73 | 0.78 | 0.61 | 0.68 | 0.44 |
| Generated gas calorific value | kcal/Nm3 Dry gas | 1000 | 960 | 910 | 970 | 915 |
| Gas velocity | m/s | 2.0 | 2.1 | 2.2 | 2.0 | 2.2 |

TABLE 2-continued

| Run | | 2-1 | 2-2 | 2-3 | 2-4 | 2-5 |
|---|---|---|---|---|---|---|
| Air amount supplied from sub-tuyere | Nm3/h | 3090 | 3235 | 3030 | 2860 | 2030 |
| Oxygen amount supplied from sub-tuyere | Nm3/h | 0 | 0 | 37 | 70 | 230 |
| Vapor amount | kg/h | 0 | 0 | 0 | 110 | 660 |
| Fluidized bed temperature | ° C. | 400 | 500 | 500 | 500 | 500 |
| Generated gas $CO/H_2$ | — | 1.04 | 1.06 | 1.06 | 0.95 | 0.61 |
| Generated gas calorific value | kcal/Nm3 Dry gas | 1430 | 1390 | 1430 | 1410 | 1360 |
| Gas velocity | m/s | 2.7 | 3.1 | 2.9 | 2.9 | 2.9 |

Run 1 is a case where the temperature of the fluidized bed is 1000° C. or more. Run 2 is a case where the temperature of the fluidized bed is 500° C. or less.

In Run 1-1, the amount of supplied gas (a gas velocity) is insufficient. In Run 1-2, the air amount supplied to the sub tuyere is increased. In this case, the temperature of the fluidized bed is excessively high. Then, in Run 1-3, vapor is added to the blast to be supplied to the sub tuyere to set the temperature of the fluidized bed at a proper value. As a result, the $CO/H_2$ value is improved to about 0.6.

Run 1-4 is a case where both the air amount and vapor amount to be supplied to the sub tuyere are reduced.

In Run 1-5, to further reduce the $CO/H_2$ value of the generated gas, the vapor amount is increased and oxygen is added. On the other hand, the amount of air to be supplied to the sub-tuyere is reduced. As a result, the $CO/H_2$ value is further reduced, rendering the generated gas suitable for a fuel.

When the gas amount (gas velocity) is insufficient, an exhaust gas may be added to the air supplied from the sub tuyere in order to increase the amount of gas, while preventing an increase of the temperature of the fluidized bed.

Run 2-1 is a case where the temperature of the fluidized bed is low. In Run 2-2, the amount of air to be supplied to the sub-tuyere is increased, with the result that the temperature of the fluidized bed increases, at the same time, the gas amount (gas velocity) increases excessively.

Then, the amount of air to be supplied to the sub tuyere is reduced and oxygen is added to the blast in Run 2-3. As a result, the temperature of the fluidized bed and gas amount (gas velocity) exhibit optimum values.

In Run 2-4, vapor is added to reduce the $CO/H_2$ value, at the same time, oxygen is added and air is reduced.

In Run 2-5, both vapor and oxygen are increased but air is decreased to improve the $CO/H_2$ value.

As described in the foregoing, according to the present invention, the temperature of the fluidized bed can be decreased by adding vapor or an exhaust gas to the blast to be supplied to the sub tuyere. In addition, the $CO/H_2$ ratio can be lowered by adding vapor to the blast.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A gasified and melting furnace comprising:

an upper furnace portion defining a freeboard therein, said freeboard being provided for suppressing generation of tar and dioxin in a gas generated in the furnace and for preventing dust scattering;

a lower furnace portion in which a waste deposition layer is to be formed;

a feed inlet which has an opening at said lower furnace portion substantially on a center axis of said lower furnace portion, and through which waste and additives are to be loaded i n said lower furnace portion; and a layer height measuring device which measures a height of said waste deposition layer and which is positioned substantially on the axis of said lower furnace portion;

wherein said upper furnace portion has its central axis shifted from the center axis of said lower furnace portion by 50% or more of an inner diameter of said lower furnace portion, and said upper furnace portion has an inner diameter larger than that of said lower furnace portion.

* * * * *